US008720141B2

(12) United States Patent
Shembekar et al.

(10) Patent No.: US 8,720,141 B2
(45) Date of Patent: May 13, 2014

(54) WALL STRUCTURE WITH ENHANCED CLADDING SUPPORT

(71) Applicant: Dow Global Technologies LLC, Midland, MI (US)

(72) Inventors: Prashant Sharad Shembekar, Pune-Mn (IN); Myron J. Maurer, Saginaw, MI (US); Elena Enache Pommer, Midland, MI (US); Gary D. Parsons, Midland, MI (US); Jeffrey M. Hansbro, North Wales, PA (US); John E. Lastovica, III, Midland, MI (US); Michael H. Mazor, Midland, MI (US); Craig S. Buck, Butler, PA (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/924,660

(22) Filed: Jun. 24, 2013

(65) Prior Publication Data

US 2014/0007534 A1 Jan. 9, 2014

Related U.S. Application Data

(60) Provisional application No. 61/667,450, filed on Jul. 3, 2012.

(51) Int. Cl.
*E04C 1/00* (2006.01)
*E04B 2/74* (2006.01)

(52) U.S. Cl.
CPC ..... *E04B 2/7457* (2013.01); *E04B 2/7412* (2013.01)
USPC ..... 52/309.8; 52/481.1

(58) Field of Classification Search
CPC ..... E04B 2/7457; E04B 2/7412; E04B 2001/2466
USPC ..... 52/309.8, 309.9, 309.11, 733.2, 404.1, 52/404.2, 406.2, 98, 847, 481.1
See application file for complete search history.

(56) References Cited

U.S. PATENT DOCUMENTS

| | | | | | |
|---|---|---|---|---|---|
| 1,998,688 | A | * | 4/1935 | Robinson et al. | 52/241 |
| 3,401,494 | A | * | 9/1968 | Anderson | 52/309.2 |
| 3,662,509 | A | * | 5/1972 | Studzinski | 52/404.1 |
| 4,001,993 | A | * | 1/1977 | Daniels | 52/376 |
| 4,120,131 | A | * | 10/1978 | Carroll | 52/310 |
| 4,236,361 | A | * | 12/1980 | Boden | 52/204.1 |
| 4,646,498 | A | * | 3/1987 | Schneller et al. | 52/309.12 |

(Continued)

OTHER PUBLICATIONS

Newport Ventures, Inc., Fastening Systems for Continuous Insulation, pp. 1-170, Albany, NY.

(Continued)

*Primary Examiner* — William Gilbert
*Assistant Examiner* — James Ference
(74) *Attorney, Agent, or Firm* — Steven W. Mork

(57) ABSTRACT

A building structure includes a framework of: (a) metal studs having walls that define an interior channel; (b) a cellular backing material extending lengthwise within the interior channel of at least a portion of the metal studs; (c) a thermally insulating layer extending over multiple metal studs; (d) fasteners extending through the thermally insulating layer, through a wall of a metal stud and into the cellular backing material within the interior channel of the metal stud; and (e) a cladding attached to the framework of metal studs by means of the fasteners.

9 Claims, 5 Drawing Sheets

(56) References Cited

U.S. PATENT DOCUMENTS

| | | | | | |
|---|---|---|---|---|---|
| 4,719,730 | A * | 1/1988 | Winkowski | 52/238.1 |
| 4,742,645 | A * | 5/1988 | Johnston | 49/372 |
| 5,210,990 | A * | 5/1993 | Kirk, Jr. | 52/664 |
| 5,329,738 | A * | 7/1994 | Ovaert et al. | 52/410 |
| 5,452,556 | A * | 9/1995 | Taylor | 52/847 |
| 5,590,505 | A * | 1/1997 | Bogle | 52/836 |
| 5,701,711 | A * | 12/1997 | Bases et al. | 52/506.03 |
| 5,713,176 | A * | 2/1998 | Hunt | 52/847 |
| 5,822,940 | A * | 10/1998 | Carlin et al. | 52/479 |
| 5,992,110 | A * | 11/1999 | Clear | 52/271 |
| 6,065,259 | A * | 5/2000 | Clear | 52/284 |
| 6,125,608 | A * | 10/2000 | Charlson | 52/847 |
| 6,158,190 | A * | 12/2000 | Seng | 52/841 |
| 6,494,012 | B2 * | 12/2002 | Seng | 52/841 |
| 6,578,335 | B2 * | 6/2003 | Poliquin | 52/481.2 |
| 6,612,087 | B2 * | 9/2003 | diGirolamo et al. | 52/712 |
| 6,745,531 | B1 * | 6/2004 | Egan | 52/302.1 |
| 6,918,218 | B2 * | 7/2005 | Greenway | 52/267 |
| 6,938,387 | B2 * | 9/2005 | Belanger | 52/645 |
| 6,993,883 | B2 * | 2/2006 | Belanger | 52/847 |
| 7,162,847 | B2 * | 1/2007 | Gigiakos | 52/846 |
| 7,284,355 | B2 * | 10/2007 | Becker et al. | 52/712 |
| 7,753,220 | B2 * | 7/2010 | Konstant | 211/191 |
| 2001/0037621 | A1 * | 11/2001 | Seng | 52/731.1 |
| 2003/0213208 | A1 * | 11/2003 | Belanger | 52/737.3 |
| 2003/0213209 | A1 * | 11/2003 | Belanger | 52/737.3 |
| 2004/0006942 | A1 * | 1/2004 | Greenway | 52/309.8 |
| 2005/0076611 | A1 * | 4/2005 | Crawford | 52/782.1 |
| 2005/0247021 | A1 * | 11/2005 | Schauffele | 52/782.1 |
| 2005/0257489 | A1 * | 11/2005 | Belanger | 52/733.2 |
| 2007/0294974 | A1 * | 12/2007 | Tonyan et al. | 52/481.1 |
| 2008/0104913 | A1 * | 5/2008 | Messenger et al. | 52/309.9 |
| 2008/0115450 | A1 * | 5/2008 | Brandes et al. | 52/729.5 |
| 2008/0178782 | A1 * | 7/2008 | Frobosilo et al. | 109/78 |
| 2009/0113831 | A1 * | 5/2009 | DeWildt et al. | 52/506.01 |
| 2009/0217603 | A1 * | 9/2009 | Brady | 52/127.1 |
| 2009/0320397 | A1 * | 12/2009 | Hansbro et al. | 52/302.1 |
| 2010/0139203 | A1 * | 6/2010 | Brady | 52/655.1 |

OTHER PUBLICATIONS

Parsons, Gary and Hansbro, Jeff, The Modeled and Measured Performance of Thick Continuous Insulation (ci) Under Heavy Cladding Systems, Exploring the Sustainably Built Environment, pp. 1-10, Midland, MI.

* cited by examiner

WALL STRUCTURE WITH ENHANCED CLADDING SUPPORT

BACKGROUND OF THE INVENTION

1. Field of the Invention

The present invention relates to a building structure that provides supported fasteners for holding heavy exterior cladding, the fasteners extending through a thick thermally insulating layer and into a metal stud.

2. Introduction

Metal frame building structures are relatively common, particularly in commercial building construction. Metal frame building structures typically comprise a framework of metal studs, a thermally insulating layer on the exterior surface of the metal stud framework, an exterior cladding over the thermally insulating layer and fasteners that extend through the thermally insulating layer that attach the exterior cladding to the metal studs. One of the challenges with such a metal frame building structure is providing sufficient support to keep the fasteners from pivoting (hinging) under the weight of the exterior cladding and/or under the force of wind blowing against the exterior cladding. Pivoting of the fasteners cause the cladding to sag or shift over time. The fasteners are essentially cantilevers, or lever arms, extending from a metal stud to the exterior cladding. Longer fasteners correspond to longer cantilevers that have a greater tendency to pivot at the metal stud under the load of an exterior cladding with the portion of the fastener most remote from the metal stud displacing downward under the load of the exterior cladding and/or wind forces. Often pivoting of a fastener is accompanied with local deformation, or bending, of the metal stud where the fastener attaches to the metal stud. This is particularly true with heavy exterior claddings such as wire mesh covered with stucco, brick and stone. Over time, exterior cladding can shift or sag if the fastener pivots under the weight of the exterior cladding.

Building codes are requiring an ever increasingly thickness of thermal insulation on the exterior surface of above grade metal frame building structures in order to improve the thermally insulating character of the resulting wall structure. Thermally insulating layer thicknesses of five centimeters or more are becoming desirable in the building industry. Increasing the thickness of the thermally insulating layer provides the structure with better thermally insulating properties, which generally translates into a more energy efficient building. However, thicker thermally insulating layers require longer fasteners to connect the exterior cladding to the metal studs of the metal frame. Longer fasteners are longer cantilevers between the metal studs and exterior cladding, which makes stabilizing the position of the exterior cladding more challenging. In order to accommodate thicker thermally insulating layers in metal frame building structures there must be some way to reinforce the fasteners from pivoting under the weight of the exterior cladding. Ideally, it is desirable to discover a way to reinforce the fasteners without compromising the thermal insulation property of the thermally insulating layer (for example, by increasing the density of the thermally insulating layer material or increasing the dimension or number of fasteners penetrating through the thermally insulating layer).

BRIEF SUMMARY OF THE INVENTION

The present invention provides an insulated metal frame structure that comprises exterior cladding attached to the metal frame structure over a thermally insulating layer using fasteners that are reinforced from pivoting under the load of the cladding and/or wind forces. The present invention does not compromise thermal insulation properties of the thermally insulating layer between the cladding and the metal frame structure.

The present invention stabilizes the fasteners from pivoting or hinging in a cantilever fashion by providing a cellular backing material within the metal studs into which the fasteners extend. Fasteners, which normally would merely attach to a wall of a metal stud (that is, a metal stud wall), extend through the metal stud wall and into cellular backing material. As a result, the fastener is no longer a cantilever attached to a stud at one end with a load on an opposing end. Rather, the fastener is akin to a balance beam with the stud wall serving as a fulcrum and the weight of the exterior cladding being applied to one side of the balance beam and cellular backing material providing a resistive force to the opposing side of the balance beam (that is, on the opposite side of the fulcrum). The weight of the exterior cladding applies a force that tries to tip the fastener one way with respect to the metal stud wall. The cellular backing material provides a resistive force on the other side of the metal stud wall (fulcrum) that resists tipping of the fastener under the load of the exterior cladding. A fastener that merely attaches to the metal stud wall rather than extending into a cellular backing material does not benefit from the resistive force of the cellular backing material and is more likely to move under the weight of the exterior cladding than a fastener extending through the metal stud wall and into a cellular backing material.

In one aspect, the present invention is a building structure comprising: (a) a framework of metal studs where each stud has metal walls defining an interior channel extending lengthwise within the metal stud; (b) a cellular backing material extending lengthwise within the interior channel of at least a portion of the metal studs; (c) a thermally insulating layer extending over multiple metal studs; (d) fasteners each extending through the thermally insulating layer, through a wall of a metal stud and into the cellular backing material within the interior channel of the metal stud; and (e) cladding attached to the framework of metal studs by means of the fasteners of (d) either by being attached to the fasteners or by having the fasteners extending through the cladding where the thermally insulating layer (c) is between the cladding and the framework.

The metal frame building structure of the present invention is useful for constructing buildings, particularly buildings with exterior claddings applied over a thermally insulating layer that is at least five centimeters thick.

DETAILED DESCRIPTION OF THE INVENTION

Figure 1:
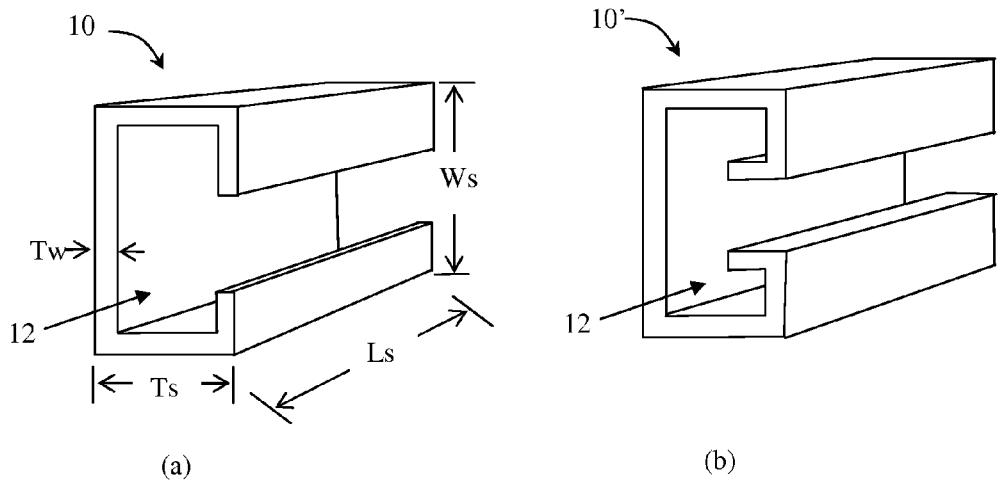
FIGS. 1(*a*), 1(*b*), and 2 illustrate examples of metal studs suitable for use in the present invention.

Test methods refer to the most recent test method as of the priority date of this document unless the test method number includes a different date. References to test methods contain both a reference to the testing society and the test method number. The following test method abbreviations apply herein: ASTM refers to American Society for Testing and Materials; EN refers to European Norm; DIN refers to Deutsches Institute für Normung; and ISO refers to International Organization for Standards.

"Length", "width" and "thickness" are three mutually perpendicular dimensions of an article. Length is a dimension having a magnitude equivalent to the largest magnitude dimension of the length, width and thickness. Thickness has a magnitude equal to the smallest magnitude of the length, width and thickness. Width has a magnitude equal to the length, thickness, both the length and thickness, or a magnitude somewhere between that of the length and thickness.

"Multiple" means two or more. "And/or" means "and, or as an alternative". All ranges include endpoints unless otherwise indicated.

In the context of the present invention, a metal frame building structure is a structure having a framework that contains at least some metal studs serving as vertical supports. The metal studs comprise a metal wall that extends in the length dimension of the stud and that defines the shape of the stud. The metal wall can be made of any metal but generally is made of cold formed sheet steel, desirably that has been galvanized, that meets or exceeds ASTM C955, A653 and A1003. The wall desirably has a thickness of 0.8 millimeters (20 gauge) or thicker, preferably 1.0 millimeters (18 gauge) or thicker, 1.4 millimeters (16 gauge) or thicker and can be 1.7 millimeters (14 gauge) or thicker and even 2.5 millimeters (12 gauge) or thicker. Generally, the wall has a thickness of 3 millimeters or less. One of the attractive features of the present invention is that because the stud wall is less like to deform or bend due to torque on fasteners it is possible to use studs having thinner walls than in other structures.

The metal wall extends along the width and thickness dimension of the stud to define an interior channel extending lengthwise within the stud. The metal wall can fully enclose the interior channel, but generally extends less than the full circumference around the interior channel (as viewed in a cross section containing the width and thickness dimensions of the stud). Common studs have a "C"-type or "I"-type profile when viewed in a cross section containing the width and thickness dimension of the stud (that is, when viewed end-on along the length dimension) where access to the interior channel is available through a space in the circumference around the stud. The metal stud can have any cross sectional shape including square, rectangular, pentagonal, and hexagonal. Rectangular profiles are most common because they are most similar to current stud shapes used in current construction (for example, "2-by" lumber studs).

Figure 2:
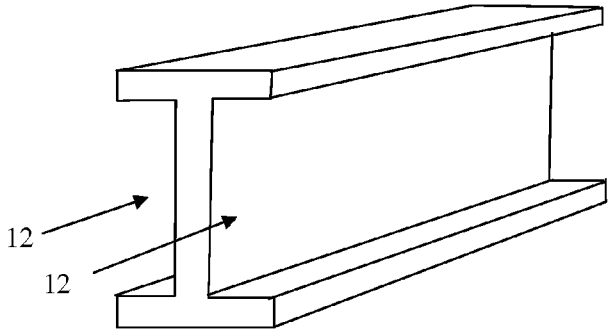

FIGS. 1(*a*), 1(*b*), 2 illustrate examples of two metal stud structures where FIGS. 1(*a*) and 1(*b*) illustrate two different studs 10 and 10', each having a different "C"-type profile. FIG. 2 illustrates stud 10 having an "I"-type profile. The Figures illustrate (for clarity, only identified in FIG. 1*a*) stud length Ls, stud width Ws, stud thickness Ts, and metal wall thickness Tw. The length of the metal wall is the same as the stud length Ls. The figures also identify interior channel 12 of the metal studs 10 and 10'. FIG. 2 illustrates that the "I"-type profile results in two interior channels 12. Notably, the drawings are not to scale and illustrate metal wall thicknesses that are greater than necessary relative to length dimensions so that the metal wall thickness are more clearly seen.

Suitable metal studs include Clark-Dietrich cold formed steel (CFS) C-studs, Bluescope Lysaght steel channels and Kingspan multichannel steel sections.

The present invention comprises a thermally insulating layer extending over multiple metal studs. In general the framework containing the metal studs has an inside surface and an outside surface. The thermally insulating layer extends over the outside surface of the framework so as to form a thermally insulating barrier protecting the inside surface from temperature fluctuations that occur beyond the outside surface (or vice versa).

The thermal insulating layer is desirably a "continuous" thermally insulating layer. A "continuous" thermally insulating layer is continuous across all structural members without thermal bridges other than fasteners and service openings. Desirably, a continuous thermally insulating layer forms an uninterrupted layer over multiple metal studs. A layer is considered "uninterrupted" if the layer is free of disruptions that exceed a continuous area of more than 25 square centimeters, preferably more than 20 square centimeters, more preferably more than 10 square centimeters in a plane perpendicular to the metal studs over which the layer extends. A continuous thermally insulating layer is most desirable because it offers the greatest thermal insulating properties to a wall. Disruptions in the thermally insulating layer can act as thermal shorts through the thermally insulating layer and thereby reduce the thermal insulating properties of the wall.

The thermally insulating layer can comprise or consist of any known thermally insulating material suitable for use in the building industry. Desirably, the thermally insulating layer comprises or consists of one or a combination of more than one material selected from a group consisting of polymeric foam, fiber-based insulation (for example, fiber batting) and mineral wool wherein the material can include or be free of facer materials. Facer materials include, for example, paper, metal foil, plastic film, metalized plastic film or a any combination of these.

The thermally insulating layer typically comprises or consists of polymeric foam insulation that can include or be free of facer materials. The thermally insulating layer is preferably an assembly of polymeric foam boards positioned over the outside surface of the framework over the metal studs and abutting one another so as to form a continuous layer of polymeric foam. Suitable polymeric foam insulation includes polymer foam comprising a continuous network of polymer selected from thermoplastic or thermoset polymers. Additionally, the continuous network of polymer can be a polymer selected from a group consisting of alkenyl aromatic polymers, olefinic polymers, polyurethane polymers, polyisocyanurate polymers, and phenolic polymer. Alkenyl aromatic polymers include styrenic polymers including polystyrene homopolymer and copolymers of styrene including styrene-acrylonitrile copolymers. Olefinic polymers include polypropylene homopolymers and copolymers and polyethylene homopolymers and copolymers.

The polymeric foam insulation can comprise boards of extruded polymer foam or expanded polymer foam. Expanded polymer foam is made by expanding beads of foamable polymer within a constraint (for example, a mold) so that the beads expand and adhere to one another while filling and conforming to a restrained shape. Expanded polymer foam is characterized by comprising multiple beads of foam with continuous polymer skin around groups of cells within the whole polymer foam. As a result, expanded polymer foam has a continuous network of polymer skin that is denser than the average cell wall extending throughout the polymer foam and encapsulating groups of cells. Expanded polymer foam is less desirable than extruded polymer foam because moisture generally is able to penetrate through the foam more readily. Extruded polymer foam is foam produced in a continuous extrusion process where boards are cut from a continuous extrudate to a desired length. Extruded polymer foam is free of the network of polymer skin found in expanded polymer foam. Extruded polymer foam is generally a better thermal insulator and moisture barrier than expanded polymer foam. Therefore, extruded polymer foam is more desirable than expanded polymer foam for the thermally insulating layer of the present invention.

Polyurethane and polyisocyanurate foam is a particular form of extruded polymer foam that is produced by extruding (expelling) an expandable froth onto a substrate and allowing it to expand and cure into polymer foam.

Polymeric foam boards for use in the thermally insulating layer desirably have a density of 16 kilograms per cubic meter ($kg/m^3$) or more and 48 $kg/m^3$ or less.

The polymeric foam insulation can be polymer foam boards with facer material on one or both opposing primary surface of the board or that is free of facer material on one or both primary surface of the foam board. A primary surface of a board is a surface having a planar surface area equal to the surface having the greatest planar surface area of the board and a surface opposing that surface (which may have and generally does have a similar planar surface area). A planar surface area is an area of a surface projected onto a plane so as to neglect contour or texture within the surface when determining surface area. Facers can include materials that increase thermal barrier properties of the foam (for example, metal facers such as aluminum facers), can increase mechanical strength of the foam (for example, paperboard facers) or that can contribute some other desirable property to the foam. A foam board can contain multiple facers in order to benefit from characteristics of each facer.

When the thermally insulating layer comprises multiple foam boards, it is desirable to further seal the joints between boards to air and moisture, for example, with tape or other sealing materials (caulk, latex or urethane foam).

The thermally insulating layer can have any thickness within the broadest scope of the present invention. However, the present invention offers particular advantages as the thermally insulating layer increases in thickness. One of the objectives of the present invention is to provide a wall system that can support heavy exterior cladding in the presence of a relatively thick (five centimeter or more) thermally insulating layer. As the thickness of the thermally insulating increases, the length of the fastener that holds the cladding to the framework of metal studs necessarily increases. The fasteners serve as lever arms with the cladding attached to one end and applying a force that tries to pivot the fastener at the metal stud to which the fastener attaches or penetrates. Therefore, thicker thermally insulating layers require longer fasteners, which correspond to longer lever arms holding the cladding, which facilitates sagging of the cladding over time. The present invention solves this problem and thereby allows construction of walls with thermally insulating layers that are particularly thick and, at the same time, cladding that is particularly heavy.

The thickness of the thermally insulating layer of the present invention can be five centimeters or more, six centimeters or more, seven centimeters or more, eight centimeters or more, nine centimeters or more and even ten centimeters or more. At the same time, the thickness of the thermally insulating layer is generally 15 centimeters or less, more typically 13 centimeters or less and still more typically 11 centimeters or less.

An exterior cladding, or simply "cladding", resides over the thermally insulating layer so that the thermally insulating layer is between the cladding and the framework of metal studs. The broadest scope of the present invention does not limit the cladding. However, as stated, one of the objectives of the present invention is to provide a wall system that can support heavy cladding (that is, cladding weighing more than 48 kilograms per square meter or 10 pounds per square foot where the area dimension refers to the area of coverage on a wall) in the presence of a relatively thick (five centimeter or more) thermally insulating layer. It is heavy cladding and relatively thick insulating layers that result in the greatest likelihood for sagging of the cladding due to pivoting of the fastener supporting the cladding. Examples of heavy cladding include wire mesh covered with stucco, Hardi Plank cementitious siding, terracotta, brick and stone. Heavy cladding introduces a greater force on the end of fasteners holding the cladding to the metal studs in the framework than lighter-weight cladding such as metal or polymeric siding (for example, aluminum siding and vinyl siding). As a result, heavy cladding tends to cause fasteners holding it to the metal studs to pivot at the metal stud resulting in undesirable sagging of the cladding on the wall over time. Therefore, the present invention is particularly well suited for use with heavy cladding such as wire mesh covered with stucco, Hardi Plank cementitious siding, terracotta, brick and stone because the present invention is more capable of supporting the heavy cladding without sagging than current structures.

The cladding is attached to the framework of metal studs by means of fasteners that extend through the thermally insulating layer and through a wall of a metal stud. Typical fasteners include bolts or self-tapping screws.

Particularly suitable fasteners include self-tapping sheet metal screws. Self-tapping sheet metal screws are externally threaded fasteners with an ability to "tap" their own internal threads in a hole and, desirably, even drill their own hole without breaking during installation. Self-tapping screws are generally high-strength steel, one-piece fasteners. Desirably, the fasteners have a diameter of 3.5 millimeters (#6 screws), 4.2 millimeters (#8 screws) or 4.8 millimeters (#10 screws). At the same time, the screws have a length sufficient to extend through the thermally insulating layer and into the interior channel of a metal stud while further attaching to a cladding. Typical lengths of fasteners include 20 millimeters (mm) or more, 30 mm or more, 50 mm or more, 70 mm or more, 90 mm or more. At the same time, the length of the fasteners is typically 110 mm or less. While any of these lengths can be used with screws of any of the stated diameters, it is generally desirable to use screws of greater diameter as the length of the screw increases. Some typical screws include:

| Screw | Diameter (mm) | Length (mm) |
|---|---|---|
| #6 × 1⅝" | 3.51 | 41.3 |
| #6 × 2" | 3.51 | 50.8 |
| #8 × 2⅝" | 4.17 | 66.7 |
| #8 × 3" | 4.17 | 76.2 |
| #10 × 4" | 4.83 | 101.6 |
| #14 × 5" | 6.35 | 127.0 |

The fasteners either extend through the cladding or the cladding is attached to the fasteners. Cladding can be attached to the fasteners, for example, with the help of metal lath or furring sections (typically steel hat section or "z" section).

A characteristic of the present invention that provides integrity to the fasteners under a load from a cladding is the presence of a cellular backing material. The present invention comprises a cellular backing material extending lengthwise within the interior channel of metal studs. Fasteners that support (that is, are attached to) an exterior cladding extend through the thermally insulating layer, through a wall of the metal stud and into the cellular backing material.

The cellular backing material provides support for the fastener that inhibits the weight of the cladding from causing the fastener to pivot at the metal stud. In the present invention the fastener acts as a balance beam with a pivot point at the metal stud wall. The weight of the cladding provides a force at one end of the balance beam (fastener). The cellular backing material provides a force at the opposing end of the balance beam (fastener) that inhibits pivoting of the balance beam (fastener) at the metal stud wall. The cellular backing material resists movement of the fastener like a counter weight on a balance.

Consider that in order for the fastener to pivot under the load of an exterior cladding, the end of the fastener that extends into the cellular backing material must move in an opposite direction as the cladding. For the fastener to move in the cellular backing material the fastener must tear through the cellular backing material into which it penetrates. Therefore, the cellular backing material's resistance to tearing provides a counter balance to the weight of the cladding.

Two parameters that contribute to how well a particular cellular material will stabilize the fastener from pivoting are: (1) the distance the fastener penetrates into the cellular backing material; and (2) the distance from the stud wall at which the fastener penetrates the cellular backing material.

Increasing the distance the fastener penetrates into the cellular backing material increases the amount of cellular material that must tear in order for the fastener to pivot. Hence, increasing the distance of fastener penetration increases the stability of the fastener from pivoting. Desirably, the fastener penetrates (or extends) into the cellular backing material to a distance of 75 percent (%) or more, preferably 90% or more and more preferably all the way through the thickness of the cellular backing material.

The distance from the stud wall at which the fastener penetrates into the cellular backing material also directly influences the extent of the counterbalancing effect of the cellular backing material. The length of fastener extending from the metal stud wall is a lever arm whose pivoting motion at the metal stud wall is inhibited by a torque applied by the cellular backing material. Torque increases with lever arm length. Therefore, the further from the metal stud wall that the fastener contacts the cellular backing material, the greater the torque resisting pivoting of the fastener under the cladding load.

It is desirable for cellular backing material to extend lengthwise within each metal stud in the framework, but it is suitable for cellular backing material to extend lengthwise within a portion, preferably a majority (that is more than 50 percent) of the studs into which fasteners supporting exterior cladding extend, more preferably within all of the metal studs into which the fasteners supporting exterior cladding extend. The cellular backing material desirably extends lengthwise within an interior channel of a stud for a sufficient length so as to have at least two fasteners that are attached to cladding and extending through the thermally insulating layer and metal stud wall penetrate into the same cellular backing material. The longer the cellular backing material the more stability it provides by distributing forces over a greater distance of the stud to resist movement.

A meaningful counterbalance of the type like the cellular backing material is absent in current building technology. Fasteners extending into a metal stud wall are free to pivot either without resistance beyond the stud wall or with minimal additional resistance provided by a nut attached to the fastener in the stud interior channel. The cellular backing material provides a greater depth of support for the fastener and therefore greater counter-balancing force to resist pivoting at the stud wall. Moreover, the cellular backing material distributes force applied by a cladding over a broad area since the cellular backing material extends over a length of the metal stud wall. As a result, heavy claddings can cause the fastener, which is essentially a cantilever attached at the stud wall, to pivot at the stud wall and often causes the stud wall to deform, bend or even tear since it cannot counteract the weight of the cladding at the other end of the cantilever.

For optimal performance, the cellular backing material is affixed or attached to the metal stud within the interior channel in which it resides. By "affixed or attached" it is meant in a manner other than by the fastener extending through the thermally insulating layer and stud wall. For example, the cellular backing material can be glued or attached to the metal stud using some other suitable adhesive or fastener. When affixed or attached to the metal stud the cellular backing material is less like to be movable within the channel and therefore imparts more resistance to movement to the fasteners that penetrate the cellular backing material.

The cellular backing material can fill the interior channel of a metal stud or only fill a portion of the interior channel of a metal stud. The cellular backing material can contact the wall of the metal stud through which the fastener extends or be spaced away from the wall through which the fastener extends. Desirably, the cellular backing material extends to a depth of 25 millimeters (mm) or more, preferably 35 mm or more and still more preferably 50 mm or more into the interior channel of a metal stud. Similarly, the fastener desirably extends into the cellular backing material to a depth of 25 mm or more, preferably 35 mm or more and still more preferably 50 mm or more to achieve greatest stability with respect to the cladding weight. Measure depth of cellular backing material and depth of penetration into the cellular backing material perpendicularly to the metal stud wall through which the fastener extends from the thermally insulating layer.

The cellular backing material comprises a continuous matrix that defines multiple cells therein. The composition of the continuous matrix is without limit in the broadest scope of the present invention. However, the continuous matrix is desirably cellulosic or polymeric. Cellulosic cellular backing materials include wood. Preferably, the cellular backing material is polymeric foam that has a polymeric continuous matrix. The polymeric foam can be a thermoplastic polymer or thermoset polymer foam. Examples of thermoplastic polymer foam include alkenyl aromatic polymer foam (for example, foam made from polystyrene and copolymers of styrene). Examples of thermoset foam include polyisocyanurate foam including polyurethane foam.

The cellular backing material can be spray polyurethane foam (SPF), particularly SPF having a density of 32 kilograms per cubic meter ($kg/m^3$) or more. However, it is desirable for the cellular backing material to be other than SPF, to comprise a cellular component in addition to SPF, and/or for the system to include a backing plate in combination with SPF in order to obtain optimal support for the fasteners of the present system. Extruded polystyrene (XPS) foam and cellulosic cellular backing materials such as wood are particularly desirable as cellular backing materials.

The cellular aspect of the cellular backing material offers numerous benefits to the backing material. For example, the cellular material is lighter weight than a non-cellular alternative. Light-weight is desirable for many reasons including ease of handling during construction of a building and reduced load on foundations relative to heavier-weight materials. The cellular aspect of the backing material can also offer acoustical dampening properties over non-cellular alternatives.

Desirably, the cellular backing material has an elastic modulus of 10 mega Pascals (MPa) or more and a compressive yield strength of at least 0.4 MPa. Determine elastic modulus and compressive yield strength according to ASTM D1621-10.

Desirably, the cellular backing material has a density of 64 $kg/m^3$ or more, preferably 100 $kg/m^3$ or more, more preferably 150 $kg/m^3$ or more, 200 $kg/m^3$ or more, 250 $kg/m^3$ or more, 300 $kg/m^3$ or more, 350 $kg/m^3$ or more and can be 400 $kg/m^3$ or more in order to provide optimal stability to the fasteners. Generally, the density of the cellular backing material is 1000 $kg/m^3$ or less. Determine density of the cellular backing material according to ASTM 1622-08.

Optionally, any embodiment of the present invention can further comprise a backing plate to which or through which the fastener attaches after extending through the thermally insulating layer, metal stud wall and cellular backing material. The backing plate, when present, resides on an opposite side of the cellular backing material than the metal stud wall through which the fastener extends. Backing plates are desirable because they can spread force applied to the cellular backing material by the fastener over a broader area and thereby can provide a more stable fastening of the cladding to the framework of metal studs. Backing plates can be localized and individual plates for each fastener or can be a plate that extends lengthwise along the cellular backing material so that multiple fasteners attach to or through a single backing plate. Backing plates can be of any material, though rigid materials are more desirable than flexible materials. Desirably, the backing plates are made from materials that include metal (for example, steel, aluminum or iron), rigid polymer, wood, stone or concrete.

Figure 3:
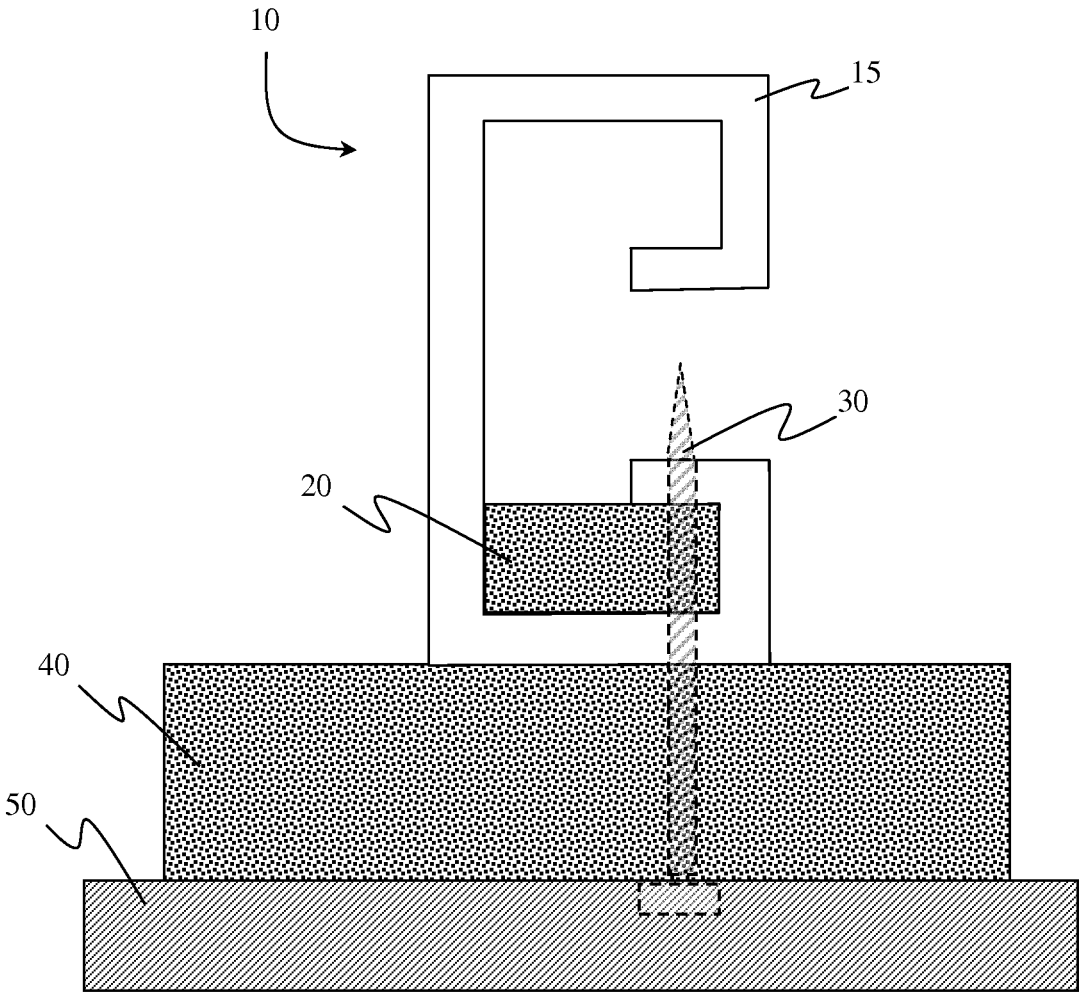
FIG. 3 provides an end-on illustration of a portion of an embodiment of the present invention showing a single metal stud with a stud wall that also serves as a backing plate.

The backing plate can be attached to (or even part of) or be free from (unattached and independent of) the metal stud. In one possible embodiment, the backing plate is part of the wall of the metal stud that wraps around opposing sides of the cellular backing material such that a fastener can extend through one portion of the wall, through the cellular backing material and attach either to or through the metal stud wall on the opposing side of the cellular backing materials. See for example, FIG. 3 illustrating metal stud 10' from FIG. 1*b*, having wall 15 that wraps around cellular backing material 20. Fastener 30 (a self-tapping screw) attaches to cladding 50 and extends through thermally insulating layer 40, cellular backing material 20 and portions of wall 15 on opposing sides of cellular backing material 20.

Figure 4:
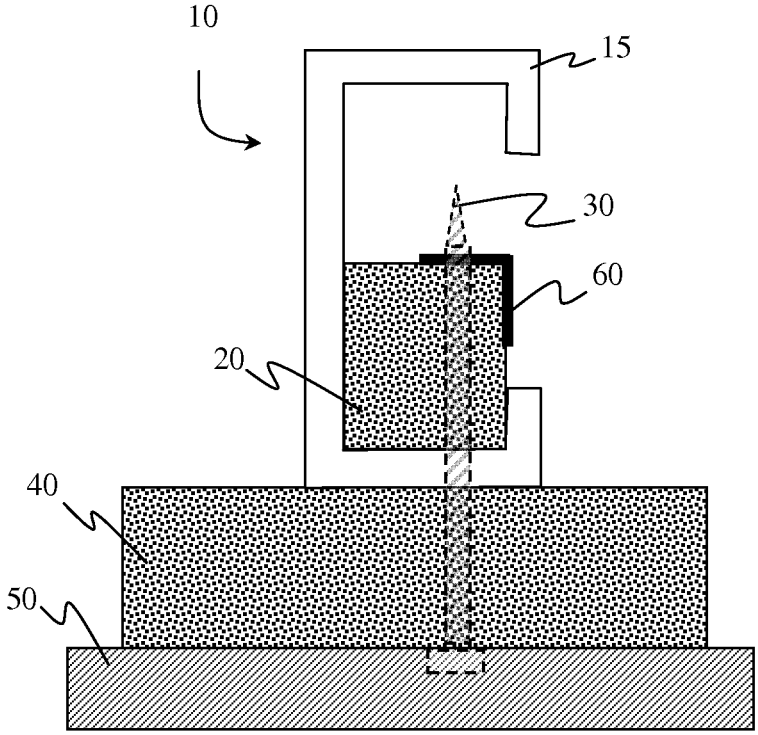
FIG. 4 provides and end-on illustration of a portion of an embodiment of the present invention showing a single metal stud and an L-shaped backing plate.

In an alternative embodiment, the backing plate is a metal strip extending lengthwise along the cellular backing material on a side of the cellular backing material. The backing plate can be an L-shaped bracket independent of the metal stud that extends lengthwise along the cellular backing material and that fits onto a corner of the cellular backing material so that one leg of the "L" shape extends onto a surface of the cellular backing material opposite the metal stud wall through which the fastener extends so that the fastener can extend through the cellular backing material and attach onto or through the leg of the backing plate. See for example, FIG. 4 illustrating metal stud 10, having wall 15 and cellular backing material 20 with L-shaped backing plate 60 positioned against cellular backing material 20 and with fastener 30 extending through wall 15, cellular backing material 20 and a leg of backing plate 60.

Figure 5:
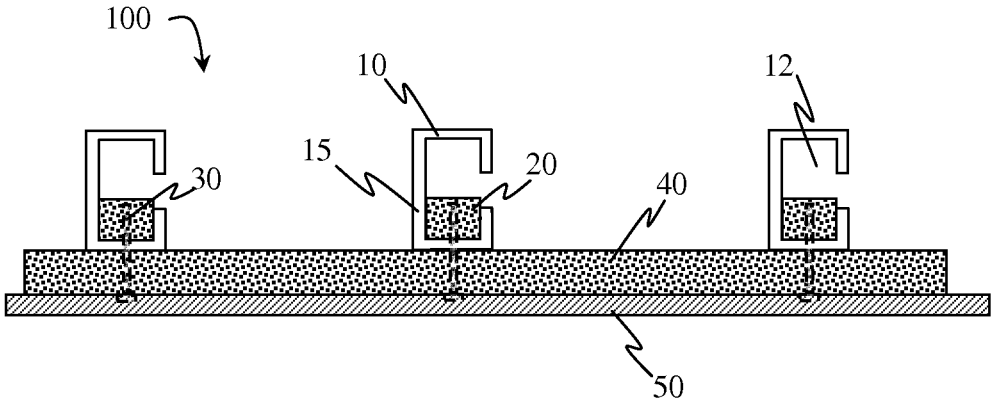
FIG. 5 provides and end-on illustration of a portion of an embodiment of the present invention showing series of three metal studs.

FIG. 5 illustrates a portion of an entire metal frame wall structure of the present invention as viewed looking directly down onto the wall in the length dimension of the metal studs so the metal studs are viewed end-on. FIG. 5 illustrates a portion of metal frame wall structure 100 comprising metal studs 10 having walls 15 defining interior channel 12. Cellular backing material 20 is within interior channel 12 and against a portion of stud wall 15. Thermally insulating layer 40 extends over multiple metal studs 10, as does cladding 50 such that thermally insulating layer 40 is between metal studs 10 and cladding 50. Fasteners 30 are attached to cladding 50 and extend through thermally insulating layer 40, a portion of metal stud wall 15 and into cellular backing 20.

EXAMPLES

The following examples serve to further illustrate embodiments of the present invention. The following examples reveal theoretical calculations using finite element modeling techniques for various configurations of a fastener extending into a metal stud that determine the deflection of the fastener under various loads. A lower deflection under load corresponds to a greater ability for the fastener to support a heavy cladding over a thermal insulating layer. The Examples reveal that extending a fastener through a wall of the stud and into a cellular backing material significantly reduces the deflection of the fastener under load (that is, provides a more positionally stable fastener). The positional stability of the fastener further increases with the density of the cellular backing material Finite Element Analysis Modeling The examples use finite element analysis modeling to determine deflection under load (positional stability) for a fastener extending into a metal stud under different configurations and upon changing select variables within the configurations. Finite element (FE) analysis was conducted using LS-DYNA™ software (version 971, January 2007; LS-DYNA is a trademark of Livermore Software Technology Corporation). FE analysis was used to determine the effect of changing select variable had on a fastener's deflection under load for a configuration. A designed experiment software (JMP™ Pro 9 software, 2012; JMP is a trademark of SAS Institute, Inc) was used to analyze the results from the FE analysis to determine if there was a significant effect on a fastener's deflection under load as any given variable was changed.

Modeling calculations were done using the following structural components:

| Element | Properties |
|---|---|
| Fastener | self-tapping steel screw of size #14 (6.45 millimeter diameter) and sufficient length to extend 101 millimeters from the stud upon screwing into the stud to the distance/depth specified for a configuration. The screw yield strength is 286 megaPascals (MPa). |
| Stud | Cold-formed steel having a "C"-shaped cross section with opposing 41.3 millimeter flanges connected by a 152.4 millimeter web. Stud steel wall thickness is 0.76 millimeters |

-continued

| Element | Properties |
|---|---|
| | to 1.9 millimeters. Stud steel yield strength is 228 MPa to 345 MPa. |
| Cellular backing material | Polymeric foam modeled after polyurethane foam (though similar trends in results expected for all cellular materials) with density varied from 32 kg/m$^3$ to 384 kg/m$^3$. The cellular backing material is bonded to the metal stud so as to not slip with respect to the stud during testing. Elastic modulus (pounds per square inch (psi)) = $E = 230\rho^{1.7}$ Compressive yield stress (psi) = $\sigma_y = 10.9\rho^{1.64}$ Density (pounds per cubic foot) = $\rho$ Values taken from: "Analysis of Rigid Polyurethane Foam as a Shock Mitigator", August 1973, Naval Ordinance Laboratory, White Oak, Silver Spring, MD 20910. Table 1, below, provides calculated values for a range of foam densities and considering no strain rate effect. |
| Backing Plate | Yield strength of 286 MPa and having a thickness of zero to 1.9 millimeters. |

TABLE 1

| Foam Density | | Elastic Modulus | | Compressive Yield Stress | |
|---|---|---|---|---|---|
| lbs/ft$^3$ | kg/m$^3$ | psi | MPa | psi | MPa |
| 2 | 32 | 747 | 5 | 34 | 0.23 |
| 2.5 | 40 | 1092 | 8 | 49 | 0.34 |
| 3 | 48 | 1489 | 10 | 66 | 0.46 |
| 4 | 64 | 2428 | 17 | 106 | 0.73 |
| 6 | 96 | 4837 | 33 | 206 | 1.42 |
| 9 | 144 | 9637 | 66 | 400 | 2.76 |
| 13 | 208 | 18007 | 124 | 732 | 5.04 |
| 18 | 288 | 31311 | 216 | 1248 | 8.60 |
| 24 | 384 | 51061 | 352 | 2000 | 13.8 |

Use the card *MAT_LOW_DENSITY_FOAM in the LS-DYNA™ software for material modeling of the foam. Use the card *MAT_PIECEWISE-LINEAR_PLASTICITY in the LS-DYNA™ software for material modeling of steel for the stud.

The studs stand vertically and the fasteners extend horizontally into the stud. Loads are applied vertically to the screw head in each case. Vertical displacement of the fastener corresponds to the displacement of the screw's head vertically from the position of the head prior to application of load.

The configuration used in these examples does not include the thermally insulating layer, but similar trends in fastener displacement are expected when a thermally insulating layer is present.

Figure 6:
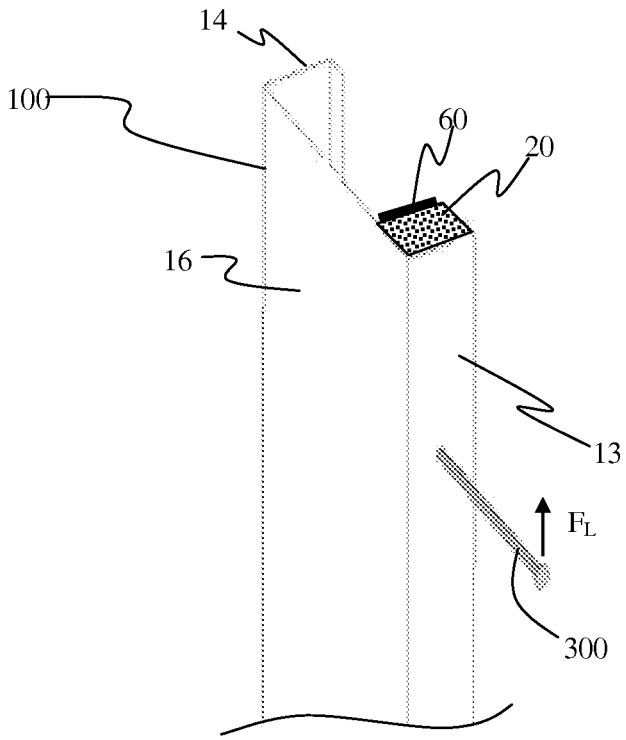
FIG. 6 illustrate an embodiment of the present invention similar to FIG. 4, but with a flat backing plate and without the thermally insulating layer and cladding.

FIG. 6 provides an illustration of the configuration used in these modeling calculations. The configuration is similar to that of FIG. 4, but without thermally insulating layer 40 and cladding 50 and with a flat backing plate 60. Metal stud 10 has a "C" cross sectional profile with opposing flanges 13 and 14 connected by web 16. Fastener 30 extends through flange 13 of metal stud 10 and, if present, into cellular backing 20 and, if present, through backing plate 60. A load force ($F_L$) is applied at the head of fastener 30 during the test and the deflection in the direction of applied force $F_L$ is determined during the test calculations.

The FE model was used to generate data over a response surface comprising five variables, each varied between three values:

| Independent Variable | Units | Low Level | Midpoint | High Level |
|---|---|---|---|---|
| Foam density | kg/m$^3$ | 32 | 208 | 384 |
| Stud Steel Yield Strength | MPa | 228 | 286 | 345 |
| Stud Steel Thickness | mm | 0.76 | 1.21 | 1.9 |
| Backup steel plate thickness | mm | 0 | 0.95 | 1.9 |
| Screw penetration in foam | mm | 12.7 | 19.1 | 25.4 |

An experimental design was created to determine the effect of each of these variable on the load required to displace the head of the fastener 1.5 millimeters.

In addition, a calculation was done for a Reference structure that did not contain a cellular backing material or backup steel plate but rather only a 0.76 mm thick steel stud having a yield strength of 228 MPa. The Reference required only a load of 2.2 N to result in a fastener head deflection of 1.5 millimeters.

Table 2 reveals the data collected for the designed experiment and the Reference.

TABLE 2

| Example | Foam Density (kg/m$^3$) | Stud Steel Yield Stress (MPa) | Stud Thickness (mm) | Backup Steel Plate Thickness (mm) | Screw Penetration into Foam (mm) | Load Causing 1.5 mm Displacement (N) |
|---|---|---|---|---|---|---|
| Reference | 0 | 228 | 0.76 | 0 | 0 | 2.2 |
| 1 | 32 | 228 | 0.76 | 0 | 12.7 | 5.5 |
| 2 | 32 | 228 | 0.76 | 1.9 | 25.4 | 37.8 |
| 3 | 32 | 228 | 1.9 | 0 | 25.4 | 27.4 |
| 4 | 32 | 228 | 1.9 | 1.9 | 12.7 | 26.8 |
| 5 | 32 | 287 | 1.33 | 0.95 | 19.05 | 16.6 |
| 6 | 32 | 345 | 0.76 | 0 | 25.4 | 7.5 |
| 7 | 32 | 345 | 0.76 | 1.9 | 12.7 | 6.0 |
| 8 | 32 | 345 | 1.9 | 0 | 12.7 | 26.7 |
| 9 | 32 | 345 | 1.9 | 1.9 | 25.4 | 41.5 |
| 10 | 208 | 228 | 1.33 | 0.95 | 19.05 | 35.1 |
| 11 | 208 | 287 | 0.76 | 0.95 | 19.05 | 32.5 |
| 12 | 208 | 287 | 1.33 | 0 | 19.05 | 31.5 |
| 13 | 208 | 287 | 1.33 | 0.95 | 12.7 | 28.0 |
| 14 | 208 | 287 | 1.33 | 0.95 | 19.05 | 34.6 |
| 15 | 208 | 287 | 1.33 | 0.95 | 19.05 | 34.6 |
| 16 | 208 | 287 | 1.33 | 0.95 | 25.4 | 46.0 |
| 17 | 208 | 287 | 1.33 | 1.9 | 19.05 | 35.3 |
| 18 | 208 | 287 | 1.9 | 0.95 | 19.05 | 37.9 |
| 19 | 208 | 345 | 1.33 | 0.95 | 19.05 | 34.6 |
| 20 | 384 | 228 | 0.76 | 0 | 25.4 | 35.5 |
| 21 | 384 | 228 | 0.76 | 1.9 | 12.7 | 33.5 |
| 22 | 384 | 228 | 1.9 | 0 | 12.7 | 38.5 |
| 23 | 384 | 228 | 1.9 | 1.9 | 25.4 | 46.0 |
| 24 | 384 | 287 | 1.33 | 0.95 | 19.05 | 41.5 |
| 25 | 384 | 345 | 0.76 | 0 | 12.7 | 31.2 |
| 26 | 384 | 345 | 0.76 | 1.9 | 25.4 | 46.0 |
| 27 | 384 | 345 | 1.9 | 0 | 25.4 | 41.5 |
| 28 | 384 | 345 | 1.9 | 1.9 | 12.7 | 39.5 |

Data Analysis

It is immediately apparent from the data by comparing the results for the Reference to the results for the Examples that extending the screw fastener into a polymeric foam cellular backing material increases the load necessary to displace the screw head extending and, as a result, will enhance the ability of the structure to support a heavy cladding attached to the fastener without sagging.

An analysis of the data using JPM™ statistical software (JMP™ Pro 9 software, 2012, SAS Institute Inc.; JMP is a trademark of SAS Institute Inc.). Model the data using a "Macro/Response Surface" with "Personality=Standard Least Squares" and "Emphasis=Effect Screening". The Summary of Fit reveals an RSquare value of 0.975, which indicates an exceptional fit between the statistical model and the test results.

Figure 7:
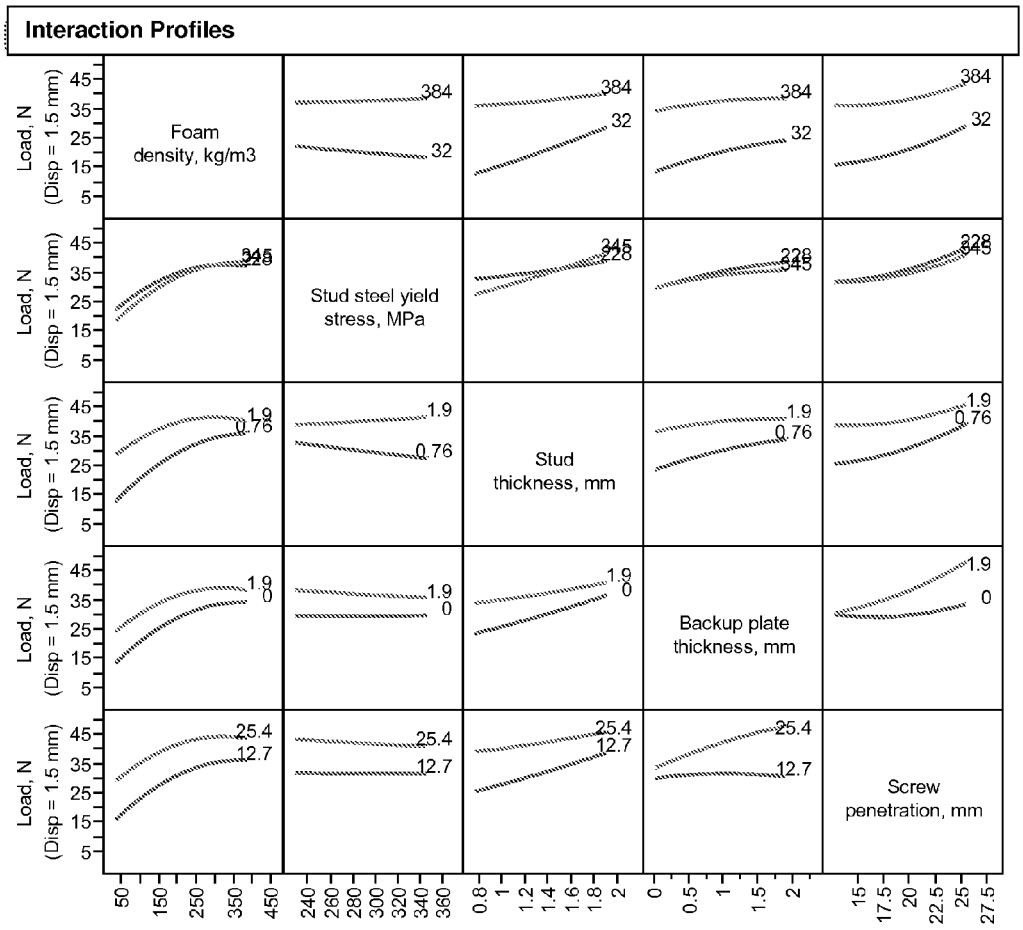
FIG. 7 illustrates interaction profiles for how different variable of the configuration in FIG. 6 affect the load bearing ability of the fastener.

FIG. 7 presents plots of the interaction profiles for the variables in the experiment. The plots reveal that an increase in load bearing ability of the fastener (more load required to achieve 1.5 mm deflection) is achievable by any of the following:

- increasing the density of the cellular backing material (polymeric foam in this case);
- increasing depth of penetration into the cellular backing material by the fastener
- extending fastener through the cellular backing material and into a backing plate
- increasing stud steel yield stress;
- increasing stud wall thickness (stud thickness).

What is claimed is:

1. A building structure comprising:

a. a framework of metal studs where each stud has metal walls defining an interior channel extending lengthwise within the metal stud;

b. a cellular backing material extending lengthwise within the interior channel of at least a portion of each metal studs;

c. a thermally insulating layer extending over two or more of the metal studs in the framework;

d. fasteners each extending through the thermally insulating layer, through a wall of a metal stud and into the cellular backing material within the interior channel of the metal stud; and e. cladding attached to the framework of metal studs by means of the fasteners of (d) where the fasteners of (d) either extend through the cladding or the cladding is attached to the fasteners and where the thermally insulating layer (c) is between the cladding and the framework;

the building structure further characterized by the cellular backing material having a thickness that is more than 25 millimeters into which the fasteners extend and wherein the fasteners extend to a depth into the cellular backing material that is at least 75 percent of the thickness of the cellular backing material.

2. The building structure of claim 1, further characterized by the cellular backing material being adhered to each metal stud apart from the fasteners.

3. The building structure of claim 1, further characterized by the cellular backing material being selected from a group consisting of polymer foam and wood.

4. The building structure of claim 1, further characterized by the cellular backing material having an elastic modulus of at least ten mega Pascals and a compressive yield strength of at least 0.4 mega Pascals, where elastic modulus and compressive yield strength are measured according to ASTM D1621-10.

5. The building structure of claim 1, further characterized by the cellular backing material being a polymeric foam having a density of 64 kilograms per cubic meter or more as determined by ASTM D7487-08.

6. The building structure of any previous claim, further characterized by the cellular backing material filling less than the entire interior channels of each metal studs of the framework.

7. The building structure of claim 1, wherein the building structure is further characterized by comprising a backing plate attached to at least one of the fasteners in (d) wherein at least one of said fasteners extends through the cellular backing material and connects to a metal plate, which serves as the backing plate, on an opposite side of the cellular backing material from the wall of the metal stud through which the fastener that has a backing plate attached to it extends.

8. The building structure of claim 1, further characterized by the thermally insulating layer having a thickness of greater than five centimeters.

9. The building structure of claim 1, further characterized by the cladding being selected from wire mesh covered with stucco, brick and stone.

* * * * *